US006548195B1

(12) United States Patent
Barbezat

(10) Patent No.: US 6,548,195 B1
(45) Date of Patent: Apr. 15, 2003

(54) COATING FOR THE WORKING SURFACE OF THE CYLINDERS OF COMBUSTION ENGINES AND A METHOD OF APPLYING SUCH A COATING

(75) Inventor: Gérard Barbezat, Opfion (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/476,009

(22) Filed: Dec. 29, 1999

(30) Foreign Application Priority Data

Jan. 19, 1999 (CH) ..... 0091/99
Feb. 9, 1999 (CH) ..... 0245/99

(51) Int. Cl.[7] ..... B32B 9/00

(52) U.S. Cl. ..... 428/701; 428/472.2; 428/702; 428/704; 428/699; 106/286.5; 106/287.17

(58) Field of Search ..... 428/544, 546, 428/551, 633, 639, 653, 655, 668, 457, 469, 472.2, 702, 704, 689, 699, 701, 632; 106/286.5, 287.17

(56) References Cited

U.S. PATENT DOCUMENTS 3,935,797 A * 2/1976 Niimi et al. ..... 92/223
5,466,906 A 11/1995 McCune, Jr. et al.
5,554,278 A * 9/1996 Henderson
5,592,927 A 1/1997 Zaluzec et al.
5,622,753 A 4/1997 Shepley et al.
5,663,124 A 9/1997 Rao et al.
5,741,556 A * 4/1998 Taylor et al.
5,766,693 A 6/1998 Rao

FOREIGN PATENT DOCUMENTS

DE 940082 3/1956
FR 735928 11/1932

OTHER PUBLICATIONS

A copy of a European Search Report dated Jun. 25, 1999 (3 pgs).

* cited by examiner

*Primary Examiner*—Deborah Jones
*Assistant Examiner*—Wendy Boss
(74) *Attorney, Agent, or Firm*—Tarolli, Sundheim, Covell & Tummino L.L.P.

(57) ABSTRACT

Ferrous coatings of the cylinder working surfaces of combustion engine blocks have a content of bound oxygen in the amount of between 1 to 4% by weight. They are characterized by extraordinary properties as far as tribology and the possibility of processing, e.g. machining, are concerned. Particularly, the coefficient of friction and the tendency to scuffing are substantially reduced. Such coatings can be realized, for example, by adding an amount of 200 to 1000 normalized liters air per minute during the plasma spraying operation.

7 Claims, 3 Drawing Sheets

COATING FOR THE WORKING SURFACE OF THE CYLINDERS OF COMBUSTION ENGINES AND A METHOD OF APPLYING SUCH A COATING

BACKGROUND OF THE INVENTION

The present invention refers to a ferrous coating applied by a plasma spraying operation to a substrate serving as a cylinder working surface of a combustion engine block. Moreover, the invention also refers to a method of applying a ferrous coating to a substrate serving as a cylinder working surface of a combustion engine block.

PRIOR ART

In the prior art, the traditional material for the working surfaces of the cylinders of combustion engine blocks that are made of aluminum or magnesium alloy is constituted by grey cast iron or cast iron blended with compacted graphite. Thereby, cylinder sleeves made of such cast iron are pressed or cast into these combustion engine blocks.

By providing such cylinder sleeves, however, on the one hand the size and the weight of the engine block is influenced in a negative sense. On the other hand, an inconvenient or adverse connection between the cylinder sleeves made of cast iron and the engine block made of a light metal alloy must be taken into account. Alternatively, also coatings applied by a galvanizing process have been used. However, the application of such coating is expensive and, moreover, such coatings may corrode under the influence of sulfuric acid and formic acid.

Furthermore, the application of a coating to bores in general by means of a plasma spraying operation is known in the art for a long time. Thereby, a variety of metallic materials can be applied to the substrate. Once the coating has been applied by means of the plasma spraying operation, the bores are further processed by diamond honing to reach their desired final diameter and provided with the desired topography. The ability of the coating to be processed and machined, respectively, and the tribologic properties are depending to a high degree on the microstructure and the physical properties of the particular coating.

OBJECTS OF THE INVENTION

It is an object of the present invention to improve the machining and processing, respectively, as well as the tribologic properties of ferrous coatings for the working surfaces of combustion engine cylinder blocks applied by a plasma spraying operation.

SUMMARY OF THE INVENTION

In order to meet this and other objects, the invention provides, in a first aspect, a ferrous coating applied by a plasma spraying operation to a substrate serving as a cylinder working surface of a combustion engine block, whereby the coating has a content of bound oxygen of between 1% and 4% by weight.

The invention is based on the surprising observation that a microstructure can be created by means of a specially controlled reaction of the powder used for the coating and oxygen during a plasma spraying operation, i.e. a microstructure comprising outstanding properties as far as machining and processing, respectively, as well as tribology are concerned. Particularly, the coefficient of friction and the tendency towards scuffing, i.e. the beginning of adhesive wear, are drastically decreased.

As previously mentioned, the coating of the invention, applied by plasma spraying, has a content of bound oxygen of between 1 and 4% by weight. As a substrate for applying such a coating, particularly suitable are:

- the cylinder bores of combustion engine cylinder blocks made of an aluminum or a magnesium alloy or of cast iron;
- the inner wall of sleeves made of cast iron and inserted into a combustion engine cylinder block made of an aluminum or a magnesium alloy.

In a preferred embodiment, the bound oxygen forms, together with the iron, FeO and $Fe_3O_4$ crystals in the coating. Thereby, it is preferred that the content of $Fe_2O_3$ amounts to less than 0.2% by weight. The amount of the formed oxides can be further controlled by mixing the air with nitrogen or oxygen. If the air is replaced by pure oxygen, the content of bound oxygen in the coating is reduced by a factor of about two.

In a second aspect, the invention also refers to a method of applying a ferrous coating to a substrate serving as a cylinder working surface of a combustion engine block. The method comprises the steps of providing a plasma spraying apparatus, providing a coating powder constituting the raw material of the coating to be applied, spraying the coating powder by means of the plasma spraying apparatus onto the cylinder working surface; and either

- supplying air to the plasma spraying apparatus and spraying the air simultaneously with the coating powder onto the substrate in an amount of between 200 and 1000 normalized liters per minute; or
- supplying an oxygen containing gas to the plasma spraying apparatus and spraying the oxygen containing gas simultaneously with the coating powder onto the substrate in an amount of between 40 and 200 normalized liters oxygen per minute; or
- supplying oxygen to the plasma spraying apparatus and spraying the oxygen simultaneously with the coating powder onto the substrate in an amount of between 40 and 200 normalized liters per minute.

The expression "normalized liters per minute" shall be understood as "liters per minute at an ambient pressure of 1 bar (=$10^5$ Pa) and a temperature of 20° C. Preferably, the velocity of the gas flow in the interior of the sleeve or cylinder bore amounts to between 7 and 12 m/s during the plasma spraying operation.

In a preferred embodiment, a gas atomized powder is plasma sprayed to the substrate, whereby the powder has the following composition:

C=0.4 to 1.5% by weight
Cr=0.2 to 2.5% by weight
Mn=0.02 to 3% by weight
P=0.01 to 0.1% by weight, if appropriate
S=0.01 to 0.2% by weight, if appropriate
Fe=difference to 100% by weight.

In another preferred embodiment, a gas atomized powder is plasma sprayed to the substrate, whereby the powder has the following composition:

C=0.1 to 0.8% by weight
Cr=11 to 18% by weight
Mn=0.1 to 1.5% by weight
Mo=0.1 to 5% by weight
S=0.01 to 0.2% by weight, if appropriate
P=0.01 to 0.1% by weight, if appropriate
Fe=difference to 100% by weight.

The amount of FeO and $Fe_3O_4$ in the coating can be influenced by the distribution of the size of the particles of the powder. Depending on the coating to be realized, the size of the particles of the powder can be in the region of between 5 to 25 μm, in the region of between 10 to 40 μm, or in the region of between 15 to 60 μm. The size of the particles can be determined by means of an optical or an electronic microscope, particularly by means of a scanning microscope, or according to the laser diffraction method MICROTRAC.

Preferably, a coating powder is used that has been gas atomized by means of argon or nitrogen.

The best results can be obtained if a coating powder is used that is blended with a tribologic oxide ceramics. Preferably, the oxide ceramics consists of $TiO_2$ or $Al_2O_3TiO_2$ and/or $Al_2O_3ZrO_2$ alloy systems. The portion of the oxide ceramics in the coating powder can amount to between 5 and 50% by weight.

It should be noted that the optimum particle size is selected according to the tribologic properties of the coating to be applied and according to the mechanical behavior of the substrate to which the coating has to be applied.

BRIEF DESCRIPTION OF THE DRAWINGS

In the following, some examples of a coating according to the invention will be further described. In the accompanying drawings.

EXAMPLE 1

Figure 1:
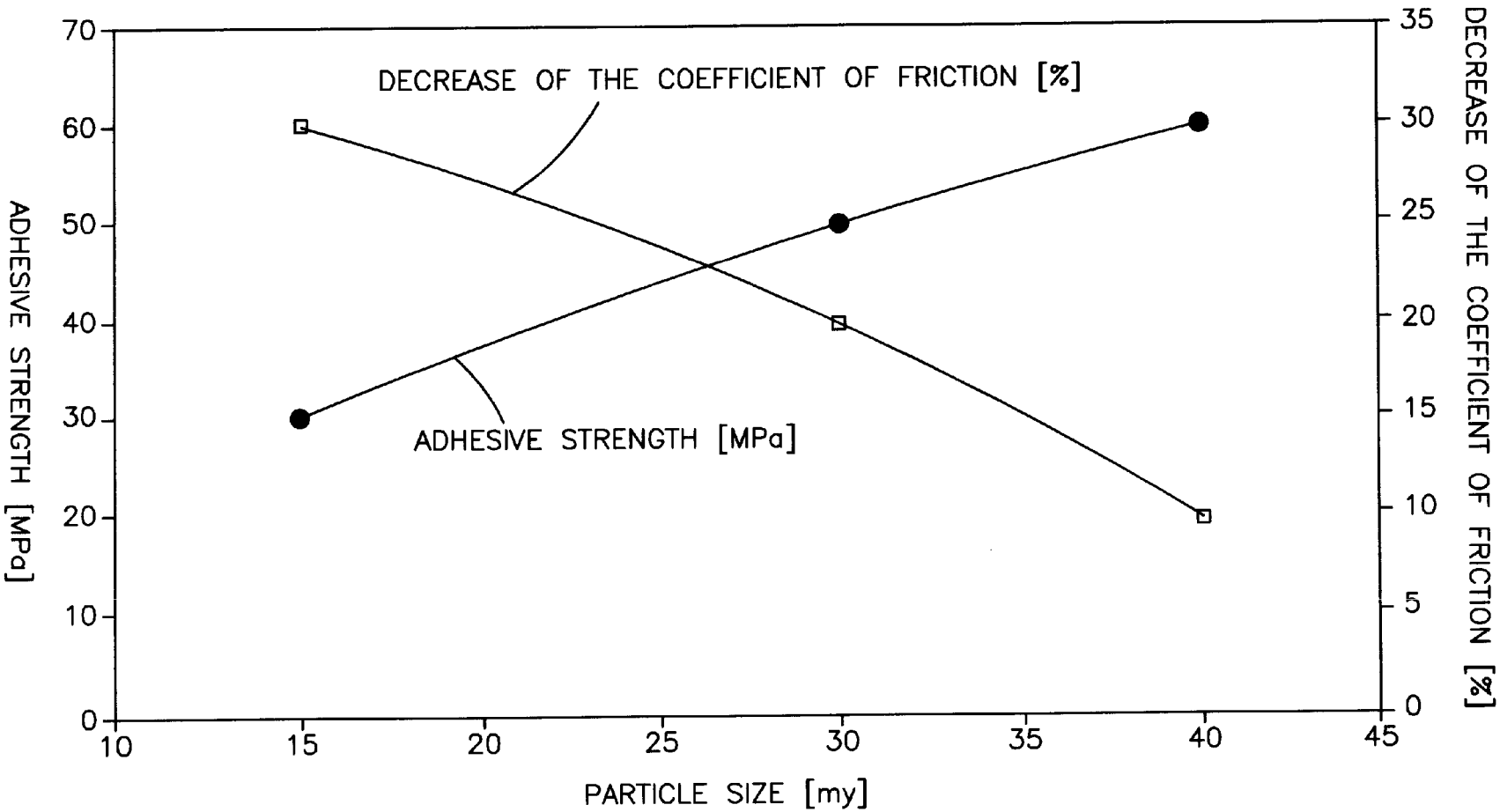
FIG. 1 shows a diagram illustrating the relation between the particle size of the coating powder and the decrease of the coefficient of friction as well as the relation between the particle size of the coating powder and the mechanical characteristics, particularly the adhesive strength of the coating.

A coating powder has been applied to the working surface of a cylinder sleeve of a combustion engine by means of a plasmatron. The coating powder had the following composition:

C=1.1% by weight

Cr=1.5% by weight

Mn=1.5% by weight

Fe=difference to 100% by weight.

If appropriate, the coating powder may also contain S and P in small amounts (i.e. 0.01 to 0.2% by weight).

The size of the particles of the coating powder was between 5 and 25 μm. The powder has been manufactured by a gas atomizing process. The velocity of the gas flow during the operation of applying the coating was 10 m/s, and the amount of air fed to the plasmatron for cooling the coating and for the reaction of the powder was 500 NLPM (normalized liters per minute). This corresponds to about 100 NLPM pure oxygen. That amount of air was fed through the body of a plasmatron well known in the art, e.g. as described in U.S. Pat. No. 5,519,183.

The results of the experiments that have been run have shown that the content of oxygen in the applied coating was in the region of 3% by weight. According to a macro structural analysis performed by means of X-rays, the oxygen is bound according to the stoichiometric formulas FeO and $Fe_3O_4$. Moreover, that analysis has shown that the presence of $Fe_2O_3$ is below the detectable limit.

The coating having been applied, the cylinder sleeve was further processed by diamond honing. Experiments with a combustion engine provided with such cylinder sleeves have clearly confirmed that the coefficient of friction between the piston rings and the wall of the cylinder sleeve is substantially reduced, as compared to well known cylinder sleeves made of grey cast iron.

EXAMPLE 2

A powder was used having the same composition as in Example 1 herein before, but with a particle size of between 10 and 45 μm. Moreover, all other conditions were identical to the ones described in Example 1. Thereby, it was found that the content of bound oxygen in the applied coating was in the region of 2% by weight. The other results of an analysis of the coating were the same as explained in connection with Example 1.

The coating having been applied, the cylinder sleeve was further processed by diamond honing. Experiments with a combustion engine provided with such cylinder sleeves have clearly confirmed that the coefficient of friction between the piston rings and the working surface of the cylinder sleeve again is substantially reduced, as compared to well known cylinder sleeves made of grey cast iron, whereby the reduction of the coefficient of friction is in relation to the amount of bound oxygen.

EXAMPLE 3

Cylinder sleeves that are to be used with combustion engines operated with sulphurous fuel or with methanol, such engines being subject to corrosion when they are operated at temperatures below the dew-point at the given conditions, have been coated, under the same conditions as described in Example 1, with a powder having the following composition:

C=0.4% by weight

Cr=13.0% by weight

Mn=1.5% by weight

Mo=2.0% by weight

Fe=difference to 100% by weight.

If appropriate, the coating powder may also contain S and P in small amounts (i.e. 0.01 to 0.2% by weight).

The size of the particles of the coating powder was between 10 and 45 μm.

The tests that have been run using such a coating yielded substantially the same favorable results as explained in Examples 1 and 2.

EXAMPLE 4

The same procedure was performed as described in Example 2, except that 30% by weight of an ceramics alloy powder was added to the coating powder, the ceramics alloy powder having a composition of 60% by weight $Al_2O_3$ and 40% by weight $TiO_2$. The coatings created using such a powder are mechanically reinforced due to the inclusion of the ceramics particles with a size of between 5 and 22 μm.

EXAMPLE 5

The same procedure was repeated as described in Example 4, except that 30% by weight of a ceramics alloy powder was added to the coating powder, the ceramics alloy powder having a composition of 80% by weight $Al_2O_3$ and 20% by weight $TiO_2$. The coatings created using such a powder are mechanically reinforced due to the inclusion of the ceramics particles with a size of between 5 and 22 $\mu$m.

FIG. 1 shows a diagram illustrating the relation between the particle size of the coating powder and the decrease of the coefficient of friction as well as the relation between the particle size of the coating powder and the mechanical characteristics, particularly the adhesive strength of the coating. It is evident from the diagram, on the one hand, that the coefficient of friction gets lower if the size of the particles is increased. On the other hand, the adhesive strength is gradually reduced if the particle size is increased. A good compromise may be a particle size in the region of 25 to 30 $\mu$m, whereby the adhesive strength amounting to appr. 45–50 MPa should be sufficient in most cases while the coefficient of friction is still reduced, as compared to the prior art coatings, by about 22–25%. However, if adhesive strength is the primary goal and the reduction of the coefficient of friction is but of secondary importance, one would chose a coating powder having particles with a smaller size. In another application, in which the reduction of the coefficient of friction is the primary goal and the adhesive strength of the coating is less important, one would chose a coating powder having particles with a greater size.

Figure 2:
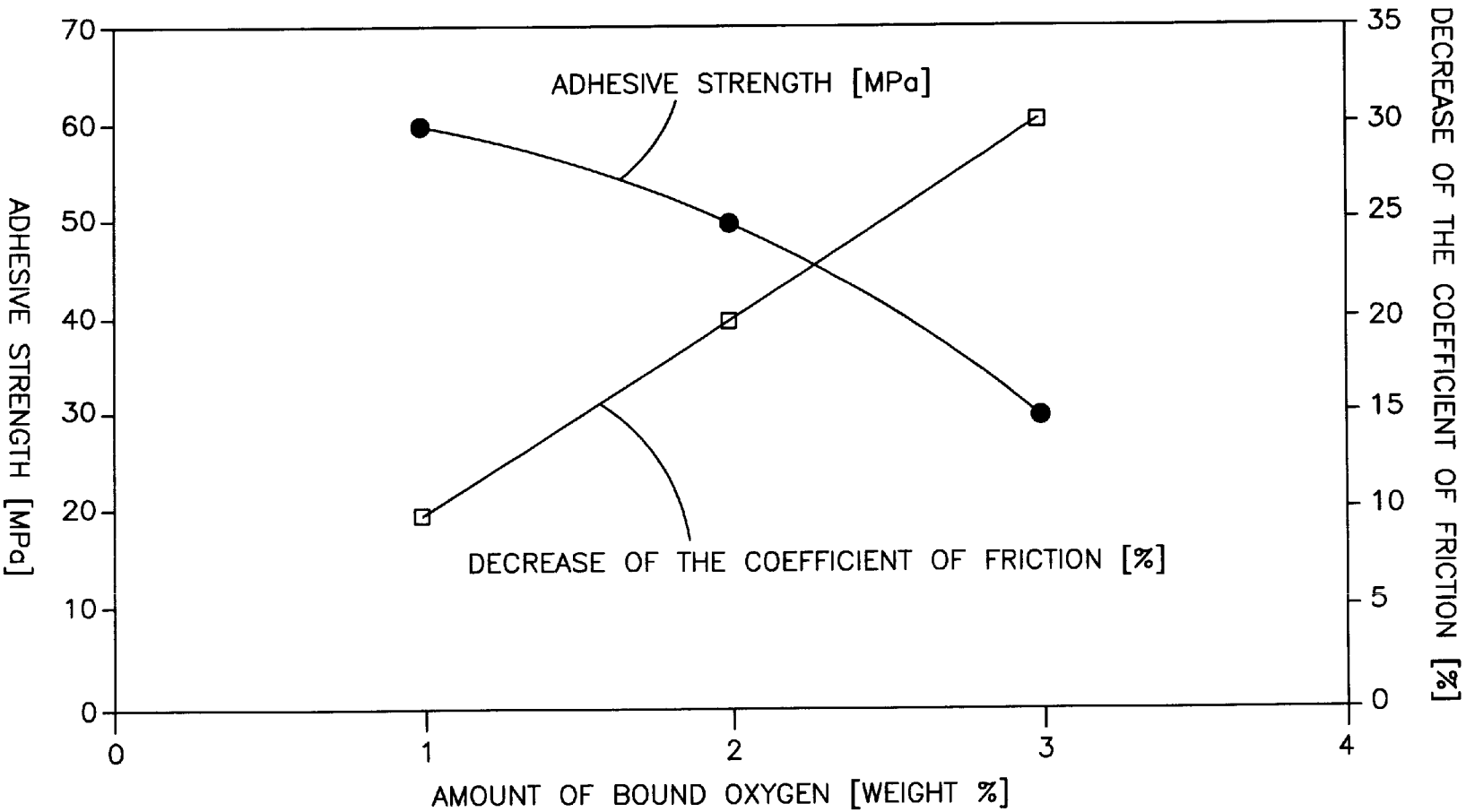
FIG. 2 shows a diagram illustrating the relation between the amount of bound oxygen in the coating and the decrease of the coefficient of friction as well as the relation between the amount of bound oxygen in the coating and the mechanical characteristics, particularly the adhesive strength of the coating.
Figure 3:
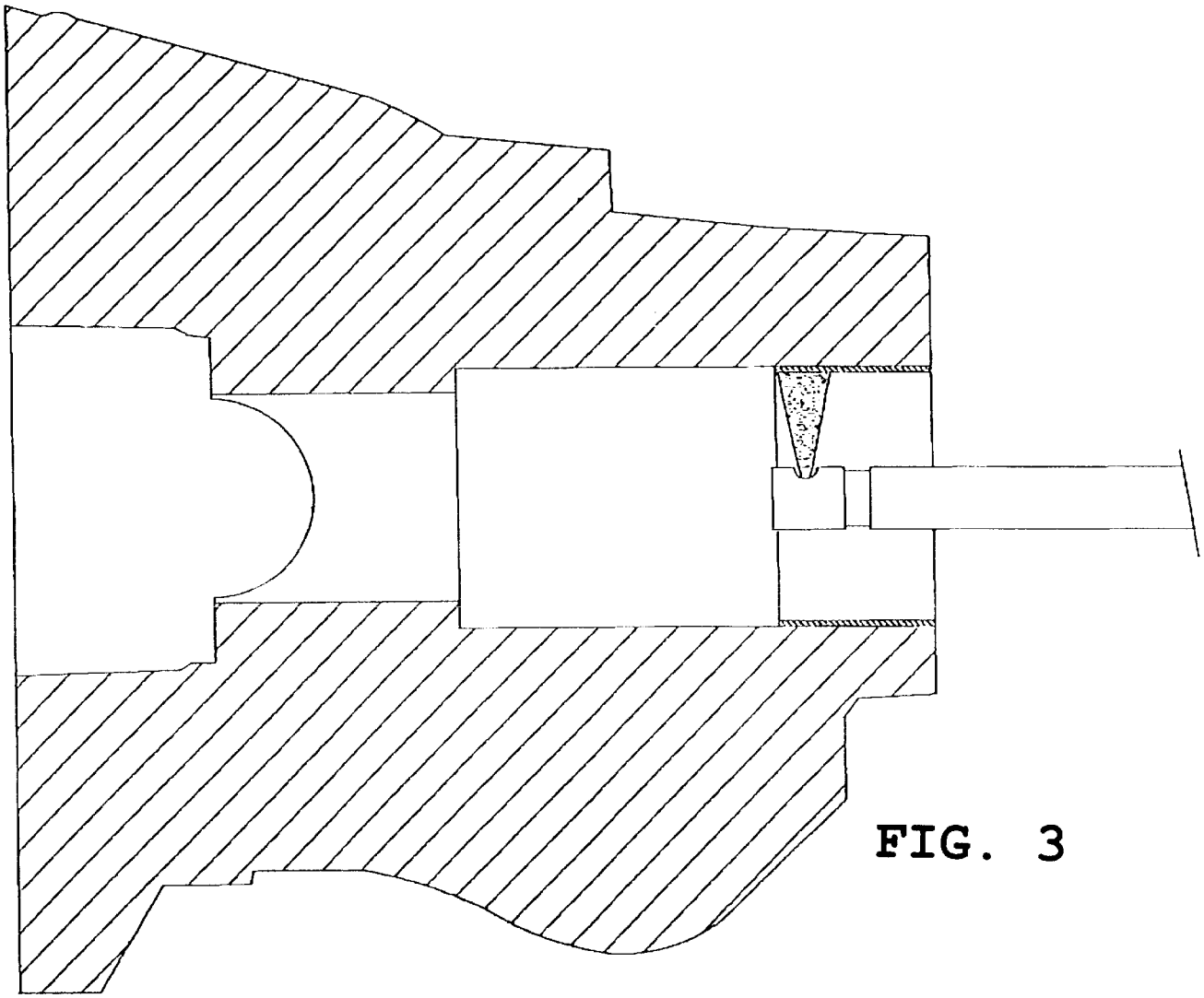
FIG. 3 is a schematic illustration showing a cylinder working surface of a combustion engine block being coated by a plasma spraying apparatus.

FIG. 2 shows a diagram illustrating the relation between the amount of bound oxygen in the coating and decrease of the coefficient of friction as well as the relation between the amount of bound oxygen in the coating and mechanical characteristics, particularly the adhesive strength of the coating. It is evident from the diagram, on the one hand, that the coefficient of friction gets lower if the amount of bound oxygen in the coating is increased. On the other hand, the adhesive strength is reduced if the amount of bound oxygen in the coating is increased. A good compromise may be a content of bound oxygen in the region of between 2–2.5% by weight, whereby the adhesive strength amounting to appr. 40–50 MPa should be sufficient in most cases while the coefficient of friction is still reduced, as compared to the prior art coatings, by about 20–25%. Correspondingly to what is explained in connection with FIG. 1, i.e. if adhesive strength is the primary goal and the reduction of the coefficient of friction is but of secondary importance, one would strive for realizing a lower content of bound oxygen in the coating. In another application, in which the reduction of the coefficient of friction is the primary goal and the adhesive strength of the coating is less important, one would strive for realizing a higher content of bound oxygen in the coating.

What is claimed is:

1. A ferrous coating applied by plasma spraying operation to a substrate serving as a cylinder working surface of a combustion engine block, said coating having a content of bound oxygen of between 1% and 4% by weight, said bound oxygen forming, together with iron, FeO and $Fe_3O_4$ crystals.

2. The ferrous coating according to claim 1, further including $Fe_2O_3$ in an amount of less than 0.2% by weight.

3. A ferrous coating applied by a plasma spraying operation to a substrate serving as a cylinder working surface of a combustion engine block, said coating have a content of bound oxygen of between 1% and 4% by weight, said bound oxygen forming together with iron, FeO and $Fe_3O_4$ crystals, wherein said substrate to which said coating is applied is constituted by a cylinder sleeve means made of cast iron and adapted to be inserted into an engine block made of a magnesium alloy or of an aluminum alloy.

4. A ferrous coating applied by a plasma spraying operation to a substrate serving as a cylinder working surface of a combustion engine block, said coating having a content of bound oxygen of between 1% and 4% by weight, said bound oxygen, forming together with iron, FeO and $Fe_3O_4$ crystals, said substrate to which said coating is applied being constituted by the engine block, said engine block being made of a magnesium alloy, of an aluminum alloy, or of cast iron, said cast iron being blended with compacted graphite.

5. A ferrous coating applied by a plasma spraying operation to a substrate serving as a cylinder working surface of a combustion engine block, said coating having a content of bound oxygen of between 1% and 4% by weight, said bound oxygen, forming together with iron, FeO and $Fe_3O_4$ crystals, said substrate to which said coating is applied being constituted by the engine block, said engine block being made of a magnesium alloy, of an aluminum alloy, or of cast iron, said cast iron being constituted by gray cast iron.

6. An apparatus comprising:

a combustion engine block, said engine block including a cylinder working surface; and a ferrous coating applied by a plasma spraying operation to said cylinder working surface, said coating having a content of bound oxygen of between 1% and 4% by weight, said bound oxygen, forming together with iron, FeO and $Fe_3O_4$ crystals.

7. An apparatus as defined in claim 6 wherein said engine block is made of a magnesium alloy, of an aluminum alloy, or of cast iron.

* * * * *